US010906688B2

(12) United States Patent
Burda et al.

(10) Patent No.: US 10,906,688 B2
(45) Date of Patent: Feb. 2, 2021

(54) CONTAINER WITH INTEGRAL DIVIDER WALL

(71) Applicant: Royal Box Group, LLC, Indianapolis, IN (US)

(72) Inventors: Timothy P. Burda, Cleves, OH (US); Mark D. Rivas, Melbourne, KY (US)

(73) Assignee: Royal Box Group, LLC, Indianapolis, IN (US)

( * ) Notice: Subject to any disclaimer, the term of this patent is extended or adjusted under 35 U.S.C. 154(b) by 0 days.

(21) Appl. No.: 16/390,760

(22) Filed: Apr. 22, 2019

(65) Prior Publication Data

US 2019/0322408 A1 Oct. 24, 2019

Related U.S. Application Data

(60) Provisional application No. 62/660,537, filed on Apr. 20, 2018.

(51) Int. Cl.

| | |
|---|---|
| ***B65D 5/00*** | (2006.01) |
| ***B65D 5/20*** | (2006.01) |
| ***B65D 5/22*** | (2006.01) |
| ***B65D 83/00*** | (2006.01) |
| ***B65D 5/48*** | (2006.01) |

(52) U.S. Cl.

CPC ..... *B65D 5/0015* (2013.01); *B65D 5/2095* (2013.01); *B65D 5/22* (2013.01); *B65D 5/48002* (2013.01); *B65D 83/0088* (2013.01); *B65D 2207/00* (2013.01); *B65D 2577/043* (2013.01)

(58) Field of Classification Search

CPC ..... B65D 5/0015; B65D 5/2095; B65D 5/22; B65D 5/48002; B65D 83/0088; B65D 5/5021; B65D 5/504; B65D 5/5042; B65D 5/5052; B65D 25/107

USPC ..... 229/178, 120.18, 167, 168, 120.12, 229/120.02, 120.15, 120.24, 164, 185.1; 206/485, 589, 564, 756, 590, 562; 211/73; 220/529

See application file for complete search history.

(56) References Cited

U.S. PATENT DOCUMENTS

| | | | | |
|---|---|---|---|---|
| 2,431,535 A * | 11/1947 | Bergstrom | B65D 5/38 206/564 |
| 3,009,622 A * | 11/1961 | Leone | A47F 5/112 206/485 |
| 3,314,530 A * | 4/1967 | Michalka | B65D 5/504 206/756 |
| 4,934,588 A * | 6/1990 | Johnske | B65D 5/48038 229/120.07 |
| 5,769,309 A * | 6/1998 | Beneroff | B65D 5/0281 229/120.04 |
| 6,158,653 A | 12/2000 | Kanter et al. | |
| 10,562,661 B2 * | 2/2020 | Cooper | B65D 5/64 |

* cited by examiner

*Primary Examiner* — Christopher R Demeree
(74) *Attorney, Agent, or Firm* — Fox Rothschild LLP; Gary A. Hecht

(57) ABSTRACT

Containers for holding packaging, such as blister-pack packaging, can be formed from a unitary piece of paperboard or other material. The containers have an interior defined by front and rear walls, first and second sidewalls, and a container bottom. The containers also include a divider panel that separates the interior into at least two sections. Flaps having multiple apertures for receiving corners of the packaging can be attached to the first and second sidewalls and the divider wall.

17 Claims, 9 Drawing Sheets

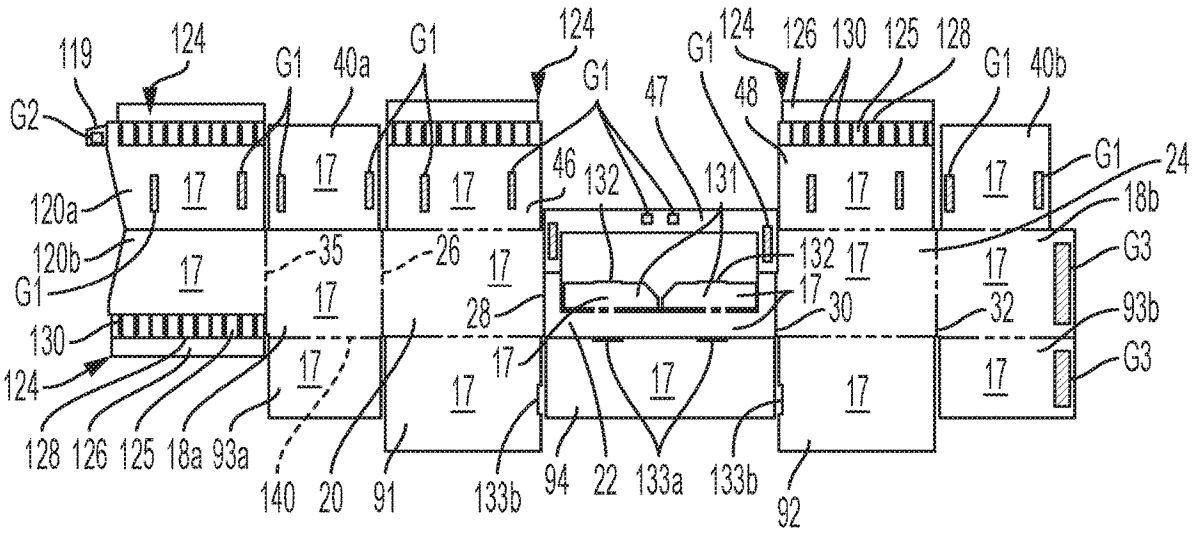
24
18b
G3
93b
G3
G1
40b
G1
128
125
130
126
124
48
G1
47
131
132
46
124
G1
G1
40a
G1
124
119
G2
120a
120b
G1
130
124
128
126
125
18a
93a
140
20
91
26
35
17
17
17

2. Fold and glueflap to front panel.

3. Fold and glue the panel down.

Fold the major flaps in and tape closed.

Square up Tray.
Fold the bottom minor flaps in.

Fold and lock the front lip flaps.

CONTAINER WITH INTEGRAL DIVIDER WALL

CROSS REFERENCE TO RELATED APPLICATIONS

This application claims the benefit of U.S. Provisional Patent Application Ser. No. 62/660,537, filed Apr. 20, 2018, the contents of which are incorporated by reference herein in their entirety.

BACKGROUND

Statement of the Technical Field

The concepts disclosed herein relate to containers configured to hold and/or display blister packs and other types of packaging.

Description of Related Art

Blister-pack packages, also generally referred to as "blister packs" or "blister cards," are in widespread use in the packaging industry. Blister packs typically comprise a transparent plastic shell shaped to the product being packaged, and a backing joined to the shell by adhesive, heat sealing, or other suitable means. Products packaged in blister packs are often shipped to retailers in display-ready containers that permit visual and physical access to the blister packs and the products contained therein, so that the products can be displayed to potential purchasers and others while located in the container.

In one form, currently know display ready containers suitable for blister packaging are formed from multiple pieces of die-cut cardboard stock. The packer or user must assemble the separate pieces before the blister packs can be placed in the container. The need to assemble a container from multiple pieces can introduce inefficiencies and add costs to the packaging process. For example, the container provider must store and ship multiple separate pieces for each container; assembling multiple pieces adds time, labor, and expense to the overall packaging process; and the use of multiple pieces generally results in a greater amount of waste of the stock material and correspondingly higher material costs in relation to containers formed from a single piece of stock material.

SUMMARY

In one aspect, the disclosed technology relates to a container having a rear wall that includes a first wall panel. The container also has a first sidewall that is attached to the rear wall, and that includes a second wall panel. The container also has a front wall that is attached to the first sidewall, and includes that a third wall panel. The container further includes a second sidewall that is attached to the rear wall and the front wall. The second sidewall has a fourth wall panel. The container also includes a bottom having a bottom flap. The bottom is attached to at least one of the front wall, the rear wall, the first sidewall, and the second sidewall.

The container further includes a divider wall having a first divider wall panel. The divider wall is configured to divide an interior of the container into at least two sections. The divider wall is integrally attached to at least one of the front wall, the rear wall, the first sidewall, and the second sidewall.

BRIEF DESCRIPTION OF THE DRAWINGS

Embodiments will be described with reference to the following drawing figures, in which like numerals represent like items throughout the figures and in which:

FIG. 4 is a top view of a unitary blank used to form the container shown in FIG. 1;

FIGS. 5, 6 and 7 are perspective views of the blank shown in FIG. 4 being folded to form a knockdown, with FIG. 7 showing a final step to forming the completed knockdown;

DETAILED DESCRIPTION

Figure 1:
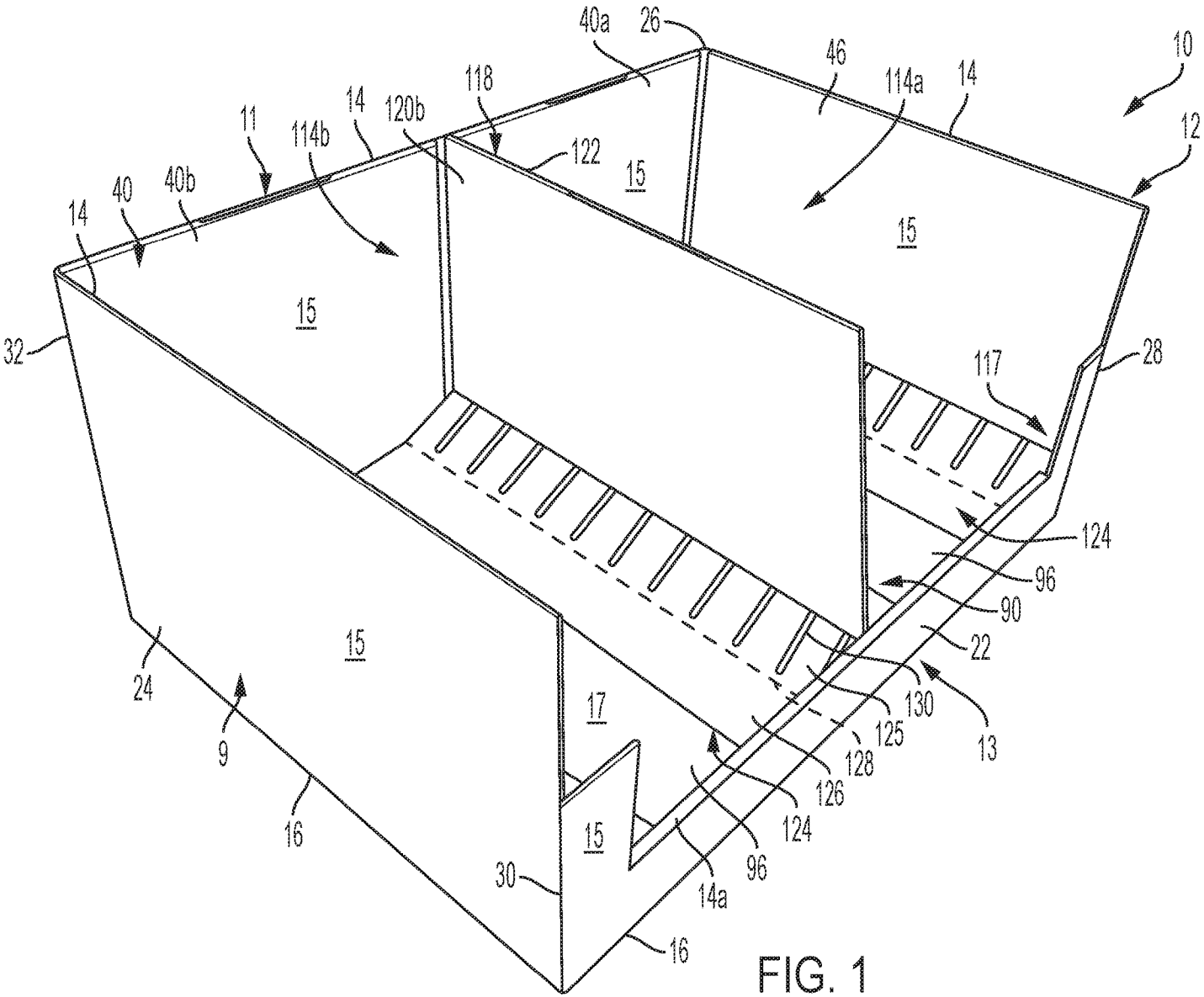
FIG. 1 is a left-front perspective view of a container configured to hold blister pack packaging, with the container shown in a fully assembled, unloaded state.

The concepts disclosed herein are for containers having novel means for holding and displaying blister-pack packages and similar items requiring support on both sides of the package. The containers can be used as display-ready containers. These particular uses are disclosed for exemplary purposes only, as the inventive concepts disclosed herein can be applied to containers used for other purposes.

The containers disclosed herein can be formed from a unitary, i.e., single-piece, die-cut blank that can be folded into a knockdown. The knockdown can be sent to the packager or other user, where it can be opened easily and assembled into its final configuration as a container ready to receive goods packaged in blister-pack packages.

Illustrated with reference to FIGS. 1-3 and 10-12 is a display ready container 10, in its fully-assembled form, for shipping and displaying blister pack packages. The container 10 has multiple wall panels integrally attached to one another to form the container sides. Each wall panel has a top end 14, a bottom end 16, an outer face 15, and an inner face 17 opposite of the outer face 15. In this particular example the multiple wall panels include a first wall panel 18 (here the rear wall), a second wall panel 20 (here a side wall), a third wall panel 22 (here the front wall), and a fourth wall panel 24 (the other side wall), as shown in FIGS. 1-3 and 11. The first wall panel 18 is formed from two partial wall panels 18*a*, 18*b* as shown, for example, in FIG. 3. The partial wall panels 18*a*, 18*b* partially overlap, and are glued together during the manufacturing process as described below. The first, second, third and fourth wall panels 18, 20, 22, and 24 are part of an integral single sheet of material, and are attached to one another as described below.

Figure 2:
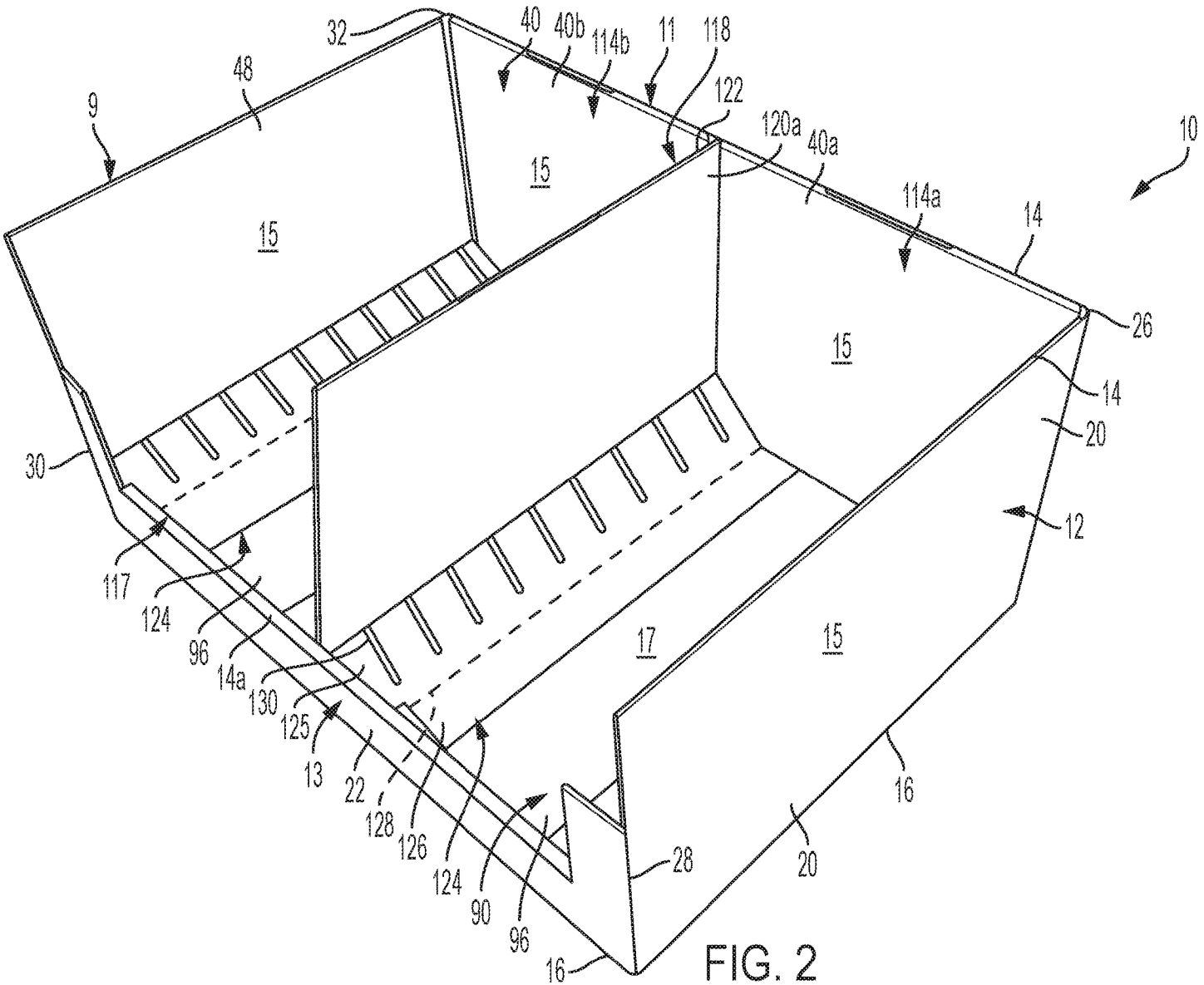
FIG. 2 is a right-front perspective view of the container shown in FIG. 1.
Figure 3:
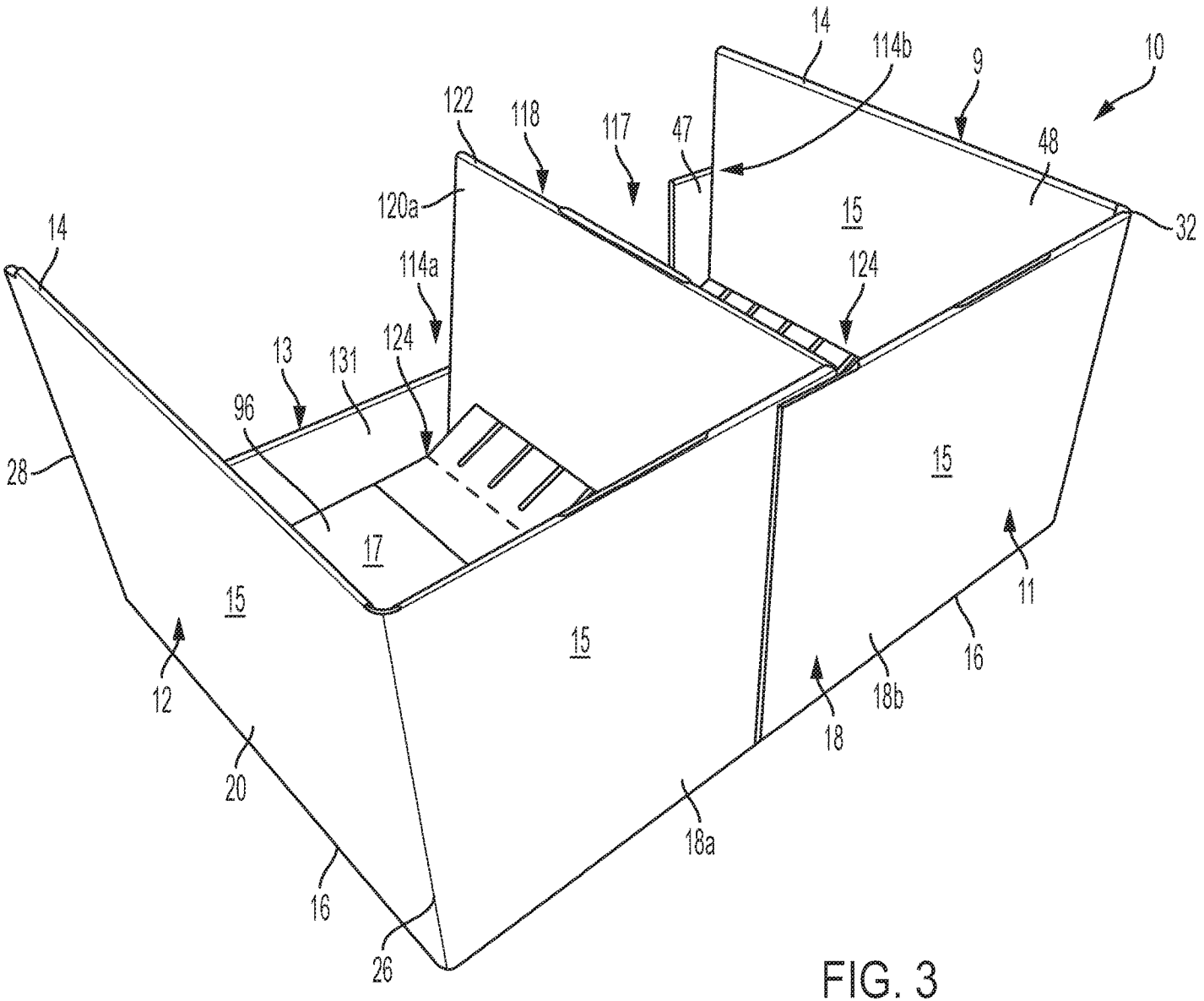
FIG. 3 is a rear perspective view of the container shown in FIG. 1.

Referring to FIGS. 1-3, the first and second wall panels 18 and 20 are integrally attached to one another at a first corner 26. The second and third wall panels 20 and 22 are integrally attached to one another at a second corner 28. The third and fourth wall panels 22 and 24 are integrally attached to one another at a third corner 30. The fourth and first wall panels 24 and 18 are integrally attached to one another at a fourth corner 32.

Figure 10:
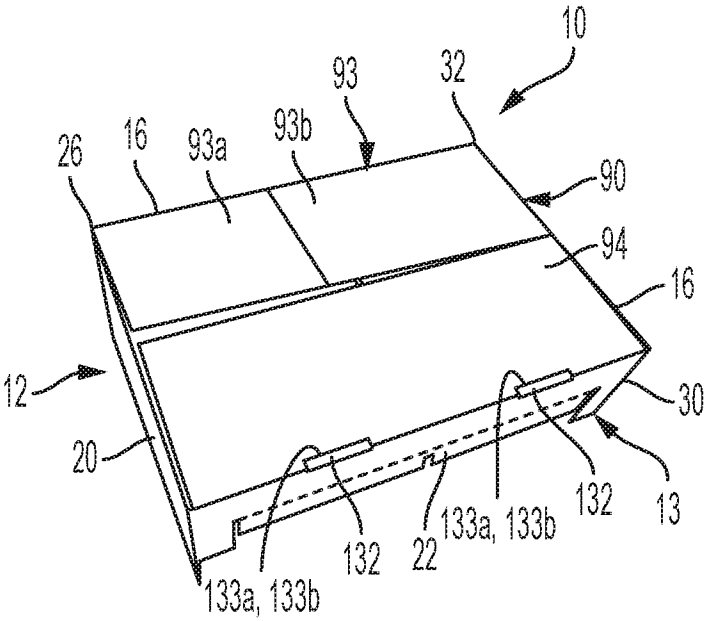
FIG. 10 is a bottom perspective view of the container shown in FIG. 9 further assembled to show the bottom of the container in a fully assembled state.
Figure 9:
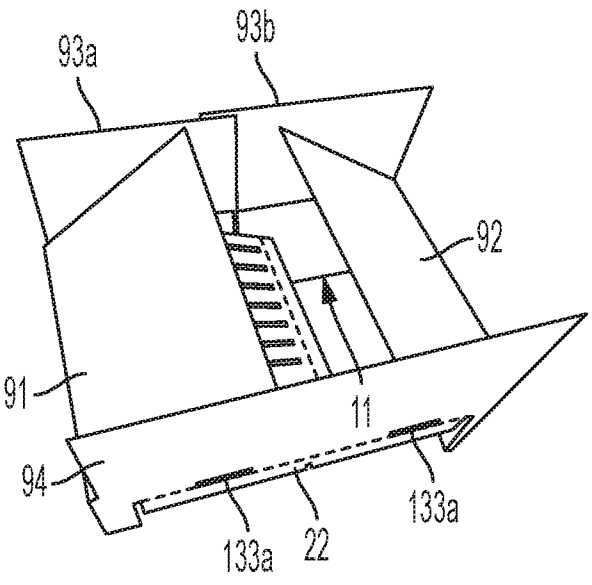
FIG. 9 is a bottom perspective view of the knockdown of FIG. 8A, being further assembled to form the container 10, with the bottom of the container in a partially-assembled state.
Figure 11A:
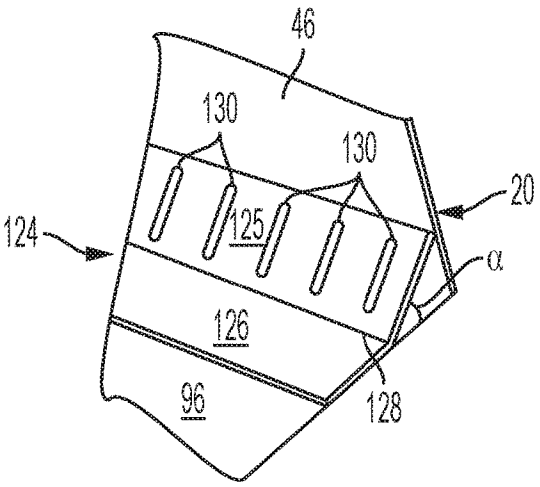
FIG. 11A is an exploded sectional view of the area denoted by the symbol "11A" in FIG. 11, with a third sidewall of the container removed to reveal underlying details.
Figure 11:
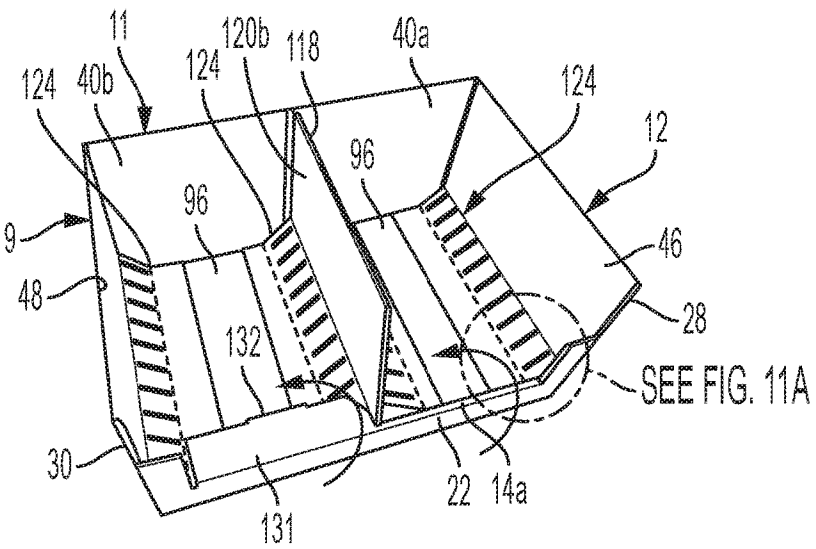
FIG. 11 is a front perspective view of the container shown in FIG. 10 further assembled to an almost fully assembled state.

With reference to FIGS. 9 and 10, the container 10 also includes a bottom 90 formed by a first bottom minor flap 91 integrally attached along the bottom end 16 of the second side panel 20; and a second bottom minor flap 92 integrally attached along the bottom end 16 of the fourth side panel 24. The bottom 90 is further formed by a first bottom major flap 93 integrally attached along the bottom end 16 of the first side panel 18; and a second bottom major flap 94 integrally attached along the bottom end 16 of the third side panel 22. The first bottom major flap 93 includes a first partial bottom flap 93*a* integrally attached to the first partial wall panel 18*a*; and a second partial bottom flap 93*b* integrally attached to the second partial wall panel 18*b*. The first and second partial bottom flaps 93*a*, 93*b* partially overlap, and are glued together during the manufacturing process in a manner known in the art.

When the container 10 is fully assembled as shown in FIGS. 1-3 and 10-12, the first and second bottom minor flaps 91, 92 form a bottom interior surface 96 within the container 10; and the first and second bottom major flaps 93, 94 form a bottom exterior surface 98 upon which the container 10 rests during normal use. A particular configuration for the bottom 90 is described herein for exemplary purposes only; many different types of container bottoms are known in the art, and any suitable bottom can be used in the alternative to the bottom 90.

Figure 2A:
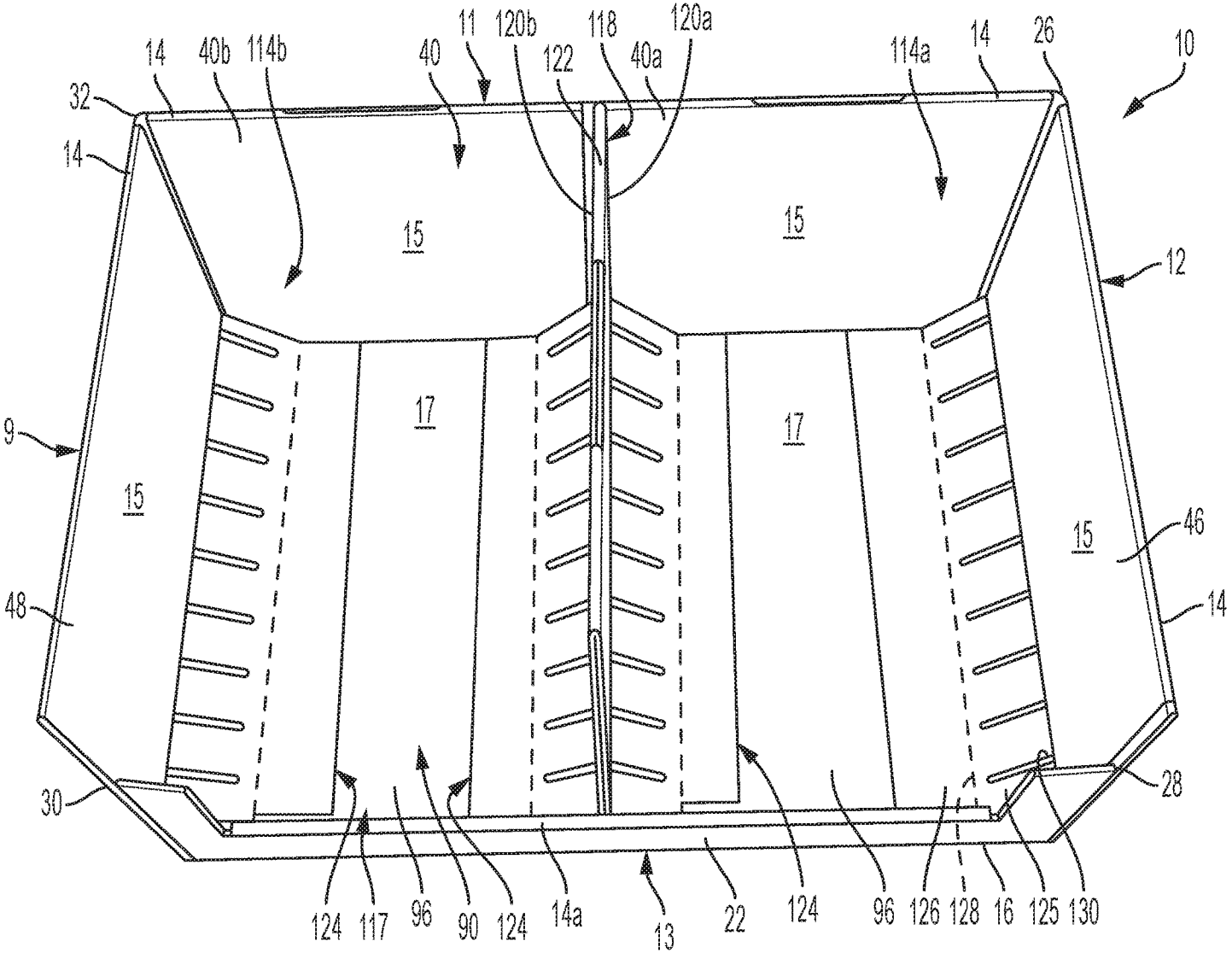
FIG. 2A is a top perspective view of the container shown in FIG. 1.

Referring to FIGS. 1, 2, and 2A the container 10 also includes a first inner wall panel 40 comprising a first partial inner wall panel 40*a* and a second partial inner wall panel 40*b*. The first and second partial inner wall panels 40*a*, 40*b* are integrally attached to the top end 14 of the respective first and second partial wall panels 18*a*, 18*b*. The first partial inner wall panel 40*a* is formed as a rollover panel attached to the inner face 17 of the first partial wall panel 18*a* in a face to face relationship as shown, using an adhesive such as hot melt glue or other suitable means. The second partial inner wall panel 40*b* likewise is formed as a rollover panel attached to the inner face 17 of the second partial wall panel 18*b*. The first inner wall panel 40 and the first wall panel 18 together form a double walled first sidewall 11 of the container 10.

In the present embodiment, the first and second partial inner wall panels 40*a* and 40*b* act as reinforcing panels for the first and second partial wall panels 18*a*, 18*b*, thereby providing a double wall structure for added strength. The first and second partial inner wall panels 40*a*, 40*b* can be smaller in width in alternative embodiments, although a suitable width for adequate gluing and strength should be maintained. Alternative embodiments can be constructed without such double-wall construction.

Referring to FIGS. 1 and 2A, a second inner wall panel 46 is formed as a rollover integrally attached to the inner face 17 of the second wall panel 20 (right side) along top edge 14 in a face to face relationship as shown, using adhesive or other suitable means. A third inner wall panel 47, visible in FIGS. 3 and 4-6, likewise is formed as a rollover integrally attached to the inner face 17 of the third wall panel 22 (front) along top edge 14. Referring to FIGS. 2, 2A, and 3, a fourth inner wall panel 48 likewise is formed as a rollover integrally attached to the inner face 17 of the fourth wall panel 24 (left side) along top edge 14. The second inner wall panel 46 and the second wall panel 20 together form a double walled second sidewall 12 of the container 10. The third inner wall panel 47 and the third wall panel 22 together form a double walled third sidewall 13 of the container 10. The fourth inner wall panel 48 and the fourth wall panel 24 together form a double walled fourth sidewall 9 of the container 10.

As with the first inner wall panel 40, the second, third, and fourth inner wall panels 46, 47, 48 can act as reinforcing panels covering a substantial portion of the respective inner faces 17 adjacent thereto. The second, third, and fourth inner wall panels 46, 47, 48 can be smaller in width in alternative embodiments, although a suitable width for adequate gluing and strength should be maintained. Alternative embodiments can be constructed without such double-wall construction.

Referring to FIGS. 3-6, the container 10 also includes two rollover lip flaps 131 integrally attached to the upper edge 14*a* of the third wall panel 22, so that an inner face 17 of each lip 130 faces the inner face 17 of the third wall panel 22, with the third inner wall panel 47 sandwiched between them. Each lip flap 131 includes a tab 132 that is capable of engaging a respective pair of slots 133*a*, 133*b* formed respectively along the edge of the second bottom major flap 94, and along the first or second bottom minor flaps 91, 92 as shown in FIGS. 4-10, thereby securing the lip flaps 131 in their respective folded positions. The folded lip flaps 131 provide a clean and smooth edge along the upper edge 14*a* of the third wall panel 22. Alternative embodiments can be constructed without such lip flaps 131.

Figure 12:
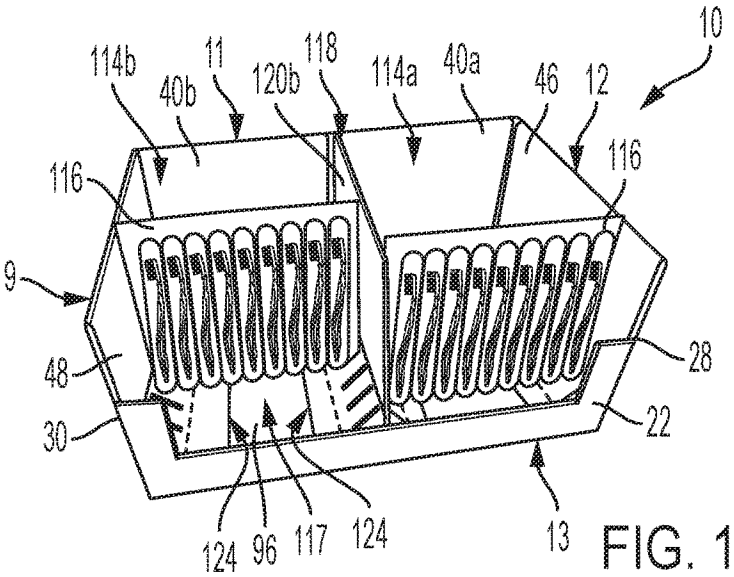
FIG. 12 is a front perspective view of the container shown in FIG. 1 partially loaded with blister cards.

The container 10 also includes a divider wall 118 that divides the container 10 into two sections 114*a*, 114*b*, as shown in FIGS. 1-3, 11, and 12. The sections 114*a*, 114*b* receive blister-pack packages 116 or other items to be displayed, as depicted in FIG. 12. A display opening 117 defined by cutouts in the third wall panel 22 and third inner wall panel 47 provides visual display and access to the sections 114*a*, 114*b* from the front of the container 10.

Referring to FIGS. 1, 3, 4, and 11, the divider wall 118 includes a first divider wall panel 120*a* and a second divider wall panel 120*b*. The second divider wall panel 120*b* is integrally attached to, and extends from an end 35 of the partial wall panel 18*a* as shown in FIG. 4. The term "integrally attached to," as used throughout the specification and claims, means unitarily formed from the same piece of paperboard or other material. The first divider wall panel 120*a* is formed as a rollover integrally attached to a top end 122 of the second divider wall panel 120*b*, and can be adhered, such as with hot melt glue, to an inner face 17 of the second divider wall panel 120*b*. The first divider wall panel 120*a* thereby provides a double-wall structure allowing added structures and features in both sections 114*a*, 114*b* as described below for holding packages. In addition, the first divider wall panel 120*a* is adhesively attached to the third inner wall panel 47 of the double walled third sidewall 13 via a glue tab 119 depicted in FIGS. 4-6.

The container 10 includes features that help to secure and support the blister-pack packages 116 within the container 10 while permitting the blister-pack packages 116 to be placed in and removed from the container 10 with relative ease. In the illustrated embodiment, the container 10 includes four wall flaps 124 as shown in FIGS. 1-3, 11, 11A, and 12. Each wall flap 124 includes a first section 125. Upper edges of the first sections 125 are integrally attached to bottom edges of the respective second inner wall panel 46; fourth inner wall panel 48; first divider wall panel 120*a*; and second divider wall panel 120*b*. Each first section 125 is separated from its respective attached panel by a suitable fold line, such as a series of perforations or a score line.

Each wall flap 124 also includes a second section 126 integrally attached to a lower edge 128 of the associated first section 125 and separated therefrom by a suitable fold line, such as a series of perforations or a score line. The lower ends of the wall flaps 124, formed by the second sections 126, are freestanding, i.e., each second section 126 is not attached or otherwise secured to any structure other than its associated first section 125. This features allows the wall flaps 124 to slide over the container bottom 90 when the container 10 is assembled. This freedom to move also provides flexibility as may be needed for receiving and holding the blister-pack packages 116.

During assembly of the container 10, each of the wall flaps 124 will move into position as the bottom 90 forming flaps are folded. In the illustrated example, each wall flap 124 is configured so that its first section 125 resides at an acute angle, denoted in FIG. 11A by the symbol "α," in relation to the bottom surface 96; and its second section 126 is supported by the container bottom interior surface 96. The angle "α" can be any angle suitable for the products to be held or displayed within the container, as well as for alternative embodiments of the invention.

Each first section 125 of the wall flaps 124 has a plurality of apertures in the form of slots 130 formed therein. The wall flaps 124 are configured so that each slot 130 substantially aligns with another slot 130 on the wall flap 124 located on the opposite side of the section 114*a* or 114*b* as shown, for example, in FIG. 11. In particular, each slot 130 formed in the wall flap 124 attached to the second inner wall panel 46 opposes a corresponding slot 130 formed in the wall flap 124 attached to the first divider wall panel 120*a*. Each slot 130 formed in the wall flap 124 attached to the fourth inner wall panel 48 likewise opposes a corresponding slot 130 formed in the wall flap 124 attached to the second divider wall panel 120*b*.

Each corresponding pair of opposed slots 130 accommodates one blister-pack packages 116. Each slot 130 can be sized so that a corner portion of the blister-pack packages 116 fits snugly within the slot as depicted in FIG. 12, although a snug fit may not be required. The angled orientation of the first sections 125 permits the lower corners of each blister-pack package 116 to be inserted into the two opposing slots 130 from above with relative ease. Once the corners of the blister-pack packages 116 are inserted, the first sections 125 of the wall flaps 124 hold the blister-pack packages 116 in an upright, or semi-upright position suitable for displaying the blister-pack packages 116. The blister-pack packages 116 can be readily removed from the container 10 by lifting the blister-pack packages 116 upward, to remove the lower corners from their associated slots 124.

The container illustrated is configured to accommodate a total of twenty blister-pack packages 116. Alternative embodiments can accommodate more, or less than this number of blister-pack packages 116.

Figure 7:
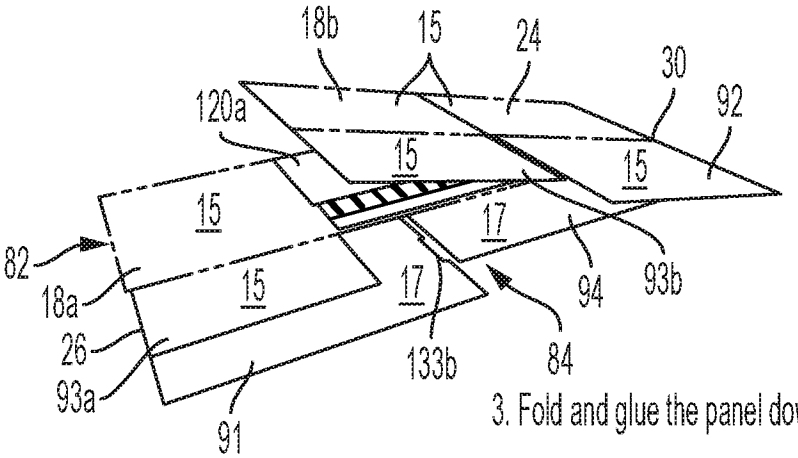

The container 10 can be made from a blank 86 of a unitary piece of single layer corrugated paperboard formed into a knockdown (collapsed) state 80 for easy stacking and shipment to the packer. The term "knockdown" refers to the flat unassembled form shown in FIGS. 7 and 8, with FIG. 7 showing the knockdown 80 in its final step of formation. The knockdown 80 has a first knockdown wall 82 and a second knockdown wall 84 attached to one another at the first and third corners 26, 30.

The first knockdown wall 82 includes the first and fourth sidewalls 11, 9, the first and second partial bottom flaps 93*a*, 93*b*, and the second bottom minor flap 92, all co-located in substantially same first plane. The second knockdown wall 84 includes the second and third sidewalls 12, 13, the lip flaps 131, the first bottom minor flap 91, and the second bottom major flap 94, all co-located in a substantially the same second plane that is substantially parallel to the first plane. "Substantially the same plane," as used herein, does not necessarily mean the exact same plane. The divider wall 118 is sandwiched between and substantially parallel to the knockdown walls 82 and 84.

Figure 8:
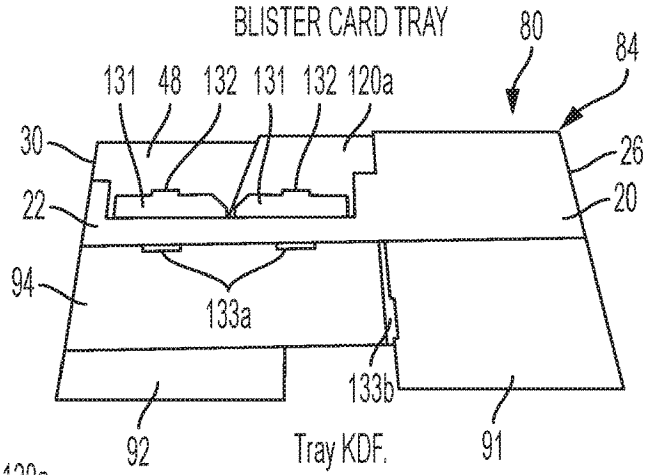
FIG. 8 is a perspective view of the knockdown shown in FIG. 7 in a fully-formed state, and showing a reverse side of the knockdown as compared to that of FIGS. 5-7.
Figure 8A:
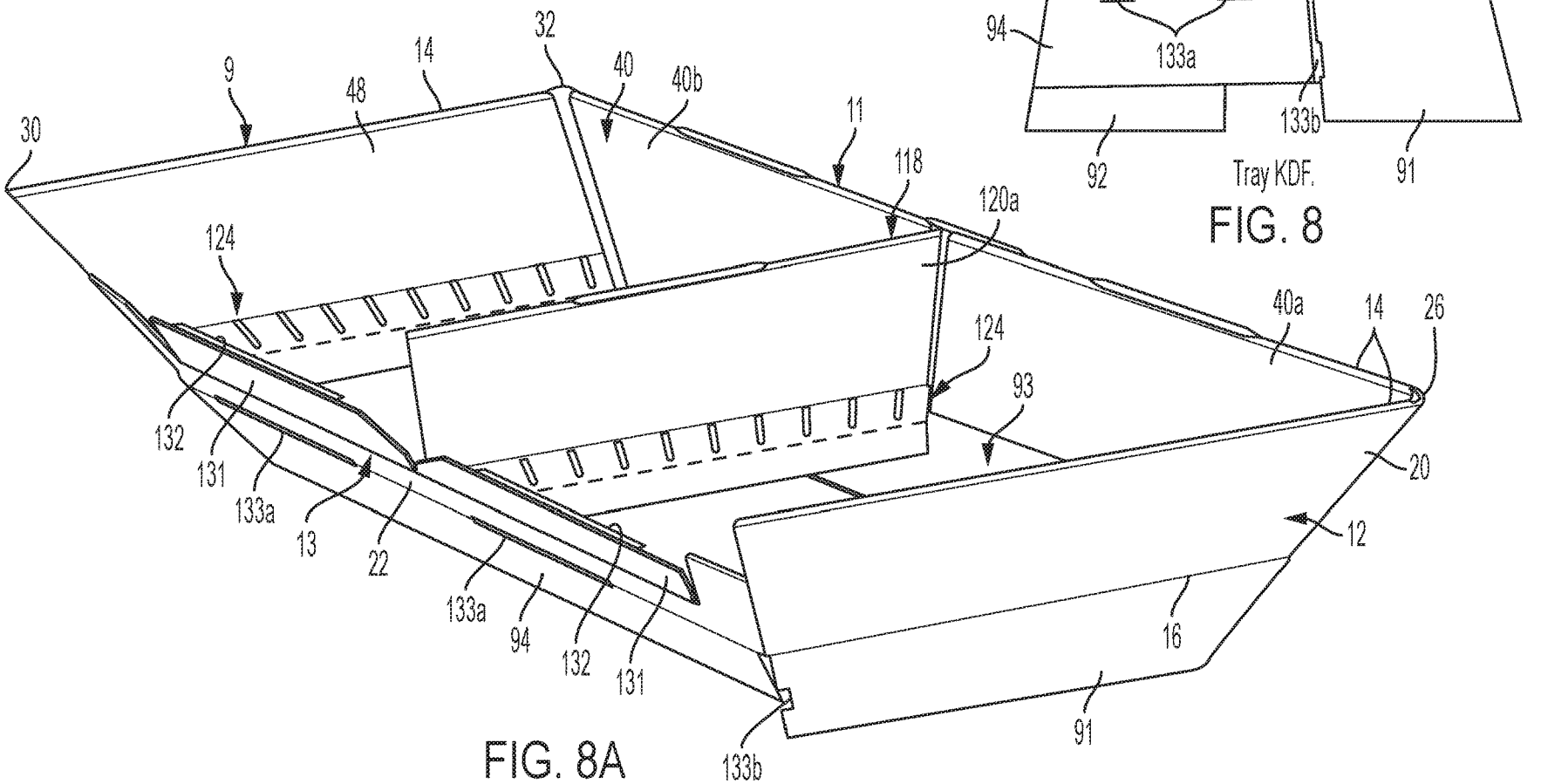
FIG. 8A is a top perspective view of the knockdown of FIG. 8 in an initial step of being opened to form the container 10.

To assemble the knockdown 80 into the display ready container 10, the two knockdown walls 82, 84 are pushed apart and folded to form the second and fourth corners 28, 32 as seen in FIG. 8A, and ultimately create the basic shape of the container 10. The bottom minor flaps 91, 92 and the bottom major flaps 93, 94 are then folded as shown in FIGS. 9 and 10 to create the container bottom 90, which can be secured using tape or other suitable means. It is seen that as the bottom minor flaps 91, 92 and the bottom major flaps 93, 94 are folded into position, the slot forming wall flaps 124, particularly the second sections 126 thereof, move into the assembled folded positions as shown in FIGS. 1-3 and 11-12. The lip flaps 131 attached to the upper edge 14 of the third wall panel 22 are then rolled over, i.e. folded inwardly, so that the projections 132 on the lip flaps 131 become disposed in the slots 133*a*, 133*b*, thereby securing the lip flaps 131 in their respective folded positions to create a clean edge 14*a*.

FIG. 4 depicts a preferred blank 86 for forming the knockdown 80 and the container 10. The blank 86 preferably is a unitary piece of material such as single-layer corrugated paperboard die cut to form the configuration shown. The view of FIG. 4 shows the respective inner faces 17 of the various parts of the container 10 as is customary in the art. The outer faces 15 are on the underside and thus are not visible in FIG. 4. The various scores, perforations, and cutouts of the container 10 are preferably provided when making the blank 86.

The blank 86 can be assembled into the knockdown 80 as described with reference to FIGS. 4-8. With the blank 86 in a flat position as shown in FIG. 4, adhesive, such as glue, is provided in glue areas G1. The first and second partial inner wall panels 40*a*, 40*b*; and the second, third, and fourth inner wall panels 46, 47, 48 then are folded (rolled over) about fold lines 140 as shown in FIG. 5. Score lines, perforations, or other means known in the art can form the fold lines 140.

Figure 6:
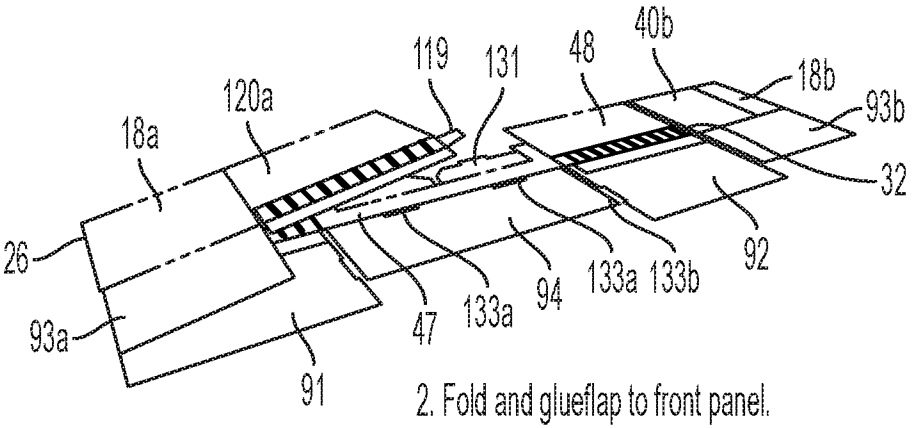

Next, the first partial wall panel 18*a*, the first partial bottom flap 93*a*, the first partial inner wall panel 40*a*, and the first and second divider wall panels 120*a*, 120*b*, with glue applied at G2 on the glue tab 119, are folded about the first corner 26 as illustrated in FIG. 6, attaching the glue tab 119 to the outer face 15 of the third inner wall panel 47 as shown.

Next, with glue applied at G3 on the edges of the second partial wall panel 18*b* and the second partial bottom flap 93*b*; the second partial wall panel 18*b*, the second partial bottom flap 93*b*, the second partial inner wall panel 40*b*, the second bottom minor flap 92, the fourth wall panel 24, and the fourth inner wall panel 48 are folded as a unit about the third corner 30 as depicted in FIG. 7. The first partial wall panel 18*a* is thus attached to the second partial wall panel 18*b* to form wall panel 18, and the first partial bottom flap 93*a* is attached to the second partial bottom flap 93*b* to form the bottom flap 93, thereby completing the knockdown 80. The knockdown 80 then can be sent to a packager or other user as a single piece ready to be assembled into the container 10 by the user.

The ability to form the container 10 from a single piece of material can reduce the costs of the container 10, and increase the efficiency of the packaging process in relation to a multi-piece container. For example, the one-piece construction of the container 10 eliminates the need to store, and ship to the user multiple pieces of material for each container 10 being used. In addition, the one-piece construction eliminates the additional time and effort required by the user to join multiple pieces together when assembling the container 10. In addition, forming the container from a single piece of material can reduce the overall cost of material of the container 10 by reducing the amount of waste material generated when forming the blank 86. For example, the exemplary embodiment of the container 10 described herein can hold up to twenty blister-pack packages 116; can be constructed using only about 22.3 square feet of paperboard; and requires only six assembly folds. A comparable multi-piece container that holds eighteen blister-pack packages requires four separate pieces of paperboard totaling over 27 square feet, and requires 43 assembly folds.

While particular embodiments of the invention are described herein, it is not intended to limit the invention to such disclosure. Changes and modifications may be incorporated without departing from the spirit and scope of the present invention. Moreover, the designation of "first," "second," etc., for the various panels and members is not limited to the particular panels or members shown herein.

We claim:

1. A container, comprising:

a rear wall comprising a first wall panel;

a first sidewall comprising a second wall panel, the first sidewall being attached to the rear wall;

a front wall comprising a third wall panel, the front wall being attached to the first sidewall;

a second sidewall comprising a fourth wall panel, the second sidewall being attached to the rear wall and the front wall;

a bottom comprising a bottom flap, the bottom being attached to at least one of the front wall, the rear wall, the first sidewall, and the second sidewall;

a divider wall comprising a first divider wall panel, the divider wall being configured to divide an interior of the container into at least two sections; the divider wall being integrally attached to at least one of the front wall, the rear wall, the first sidewall, and the second sidewall; wherein the divider wall is integrally attached to the rear wall; and wherein the divider wall further comprises a second divider wall panel integrally attached to the first divider wall panel; and a first wall flap integrally attached to the first sidewall; a second wall flap integrally attached to the second sidewall; a third wall flap integrally attached to the first divider wall panel; and a fourth wall flap integrally attached to the second divider wall panel; wherein the first, second, third, and fourth wall flaps each have a plurality of apertures formed therein.

2. The container of claim 1, wherein the apertures are slots configured to receive corner portions of blister-pack packages.

3. The container of claim 1, wherein:

the first, second, third, and fourth wall flaps each comprise a first section having the apertures formed therein, and a second section integrally attached to the first section along a first side of the second section;

the first sections of the first, second, third, and fourth wall flaps are integrally attached to the respective first side wall, second side wall, first divider wall panel, and second divider wall panel; and the second sections of the respective first, second, third, and fourth wall flaps each have a freestanding second side.

4. The container of claim 3, wherein the first sections of the first, second, third, and fourth wall flaps are oriented at an acute angle in relation to the bottom of the container.

5. The container of claim 1, wherein the first wall panel comprises a first partial wall panel integrally attached to the first divider wall panel.

6. The container of claim 5, wherein:

the first wall panel further comprises a second partial wall panel attached to the first partial wall panel;

the rear wall further comprises a fifth wall panel;

the fifth wall panel comprises a third and a fourth partial wall panel;

the third partial wall panel is integrally attached to, and faces the first partial wall panel; and the fourth partial wall panel is integrally attached to, and faces the second partial wall panel.

7. The container of claim 6, wherein:

the first side wall further comprises a sixth wall panel, the sixth wall panel being integrally attached to, and facing the second wall panel;

the front wall further comprises a seventh wall panel, the seventh wall panel being integrally attached to, and facing the third wall panel; and the second side wall further comprises an eighth wall panel, the eighth wall panel being integrally attached to, and facing the fourth wall panel.

8. The container of claim 7, wherein the first wall flap is integrally attached to the sixth wall panel; and the second wall flap is integrally attached to the eighth wall panel.

9. The container of claim 7, wherein the second divider wall panel is attached to the seventh wall panel by way of a glue tab.

10. The container of claim 7, wherein third and the seventh wall panels define a display opening to the interior of the container.

11. The container of claim 7, further comprising a lip flap integrally attached to the third wall panel and facing the seventh wall panel.

12. The container of claim 11, wherein:

the bottom flap is a first minor bottom flap integrally attached to the second wall panel;

the bottom further comprises a second minor bottom flap integrally connected to the fourth wall panel; a first major bottom flap integrally connected to the first wall panel; and a second major bottom flap integrally connected to the third wall panel; and the lip flap has a tab configured to be received in slots formed in the first minor bottom flap and the second major bottom flap.

13. The container of claim 6, wherein the first partial wall panel is integrally attached to the second wall panel; the second wall panel is integrally attached to the third wall panel; the third wall panel is integrally attached to the fourth wall panel; and the fourth wall panel is integrally attached to the second partial wall panel.

14. The container of claim 6, wherein the second partial wall panel is attached to the first partial wall panel by adhesive.

15. The container of claim 1, wherein the container is configured to be formed from a unitary blank.

16. A knockdown configured to form the container of claim 1.

17. A blank configured to form the knockdown of claim 16.

* * * * *